US005984300A

United States Patent [19]

Nishiberi

[11] Patent Number: 5,984,300

[45] **Date of Patent: *Nov. 16, 1999**

[54] SHEET TRAY DEVICE FOR LOADING SHEETS, AND A SHEET FEEDING DEVICE

[75] Inventor: Nozomu Nishiberi, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,464

[22] Filed: Apr. 18, 1997

[30] Foreign Application Priority Data

Apr. 19, 1996 [JP] Japan ..... 8-098964

[51] Int. Cl.[6] ..... B65H 1/00

[52] U.S. Cl. ..... 271/171

[58] Field of Search ..... 271/145, 162, 271/164, 171

[56] References Cited

U.S. PATENT DOCUMENTS

| | | | |
|---|---|---|---|
| 5,111,252 | 5/1992 | Hamada et al. | 271/171 X |
| 5,454,555 | 10/1995 | Kiyohara et al. | 271/145 X |
| 5,613,672 | 3/1997 | Tanaka et al. | 271/171 X |

FOREIGN PATENT DOCUMENTS

| | | | |
|---|---|---|---|
| 2276729 | 11/1990 | Japan | 271/171 |
| 5278868 | 10/1993 | Japan | 271/171 |

*Primary Examiner*—David H. Bollinger

*Attorney, Agent, or Firm*—Fitzpatrick, Cella, Harper & Scinto

[57] ABSTRACT

A sub tray of a sheet tray is arranged so as to be held by a locking mechanism in any one of at least three rotational positions relative to a main tray including an opened position, a stored position and an intermediate position. The sub tray is set in an opened position when loading sheets of a size larger than the main tray, and the sub tray is set at an intermediate position between the stored position and the opened position when continuous form paper is to be ejected via the tray. Locking the sub tray at the intermediate position guides the continuous form downwards in a gentle curve.

13 Claims, 13 Drawing Sheets

SHEET TRAY DEVICE FOR LOADING SHEETS, AND A SHEET FEEDING DEVICE

BACKGROUND OF THE INVENTION

1. Field of the Invention

The present invention relates to a tray for a recording apparatus which serves as an output apparatus for information processing apparatuses such as personal computers, word processors, facsimile apparatuses, and the like.

2. Description of the Related Art

In most cases, known recording apparatuses output to sheets which serve as the recording medium thereof. Such sheets are generally divided into two large categories: cut sheets, wherein each sheet is individually cut, and continuous form, wherein a plurality of sheets are connected and transported by transporting holes provided in each side thereof.

Until recently recording apparatuses printed character information only. Within the last few years, however, recording apparatuses have been developed which are capable of outputting photographic and image information, owing to the spectacular improvement in the processing capabilities of personal computers. Accordingly, there have also been recording apparatuses developed which are capable of outputting such varied data to both the aforementioned cut sheets and continuous form.

However, there have been problems with such known apparatuses. Namely continuous form cannot be used in the already-existing sheet feeding and sheet ejecting trays which are formed to correspond to the various sizes of cut sheets, thus necessitating provision of new sheet feeding and sheet ejecting trays for continuous form.

SUMMARY OF THE INVENTION

The object of the present invention is to provide a sheet tray for a recording apparatus which allows for smooth feeding and ejecting of both cut sheets and continuous form with a single tray.

The present invention solves the above-described problem, and forms a sheet tray device for loading sheets, comprising: a main tray for loading sheets; a sub tray provided rotatably along an edge of the aforementioned main tray; and a locking mechanism for holding the rotational position of the aforementioned sub tray; wherein the aforementioned sub tray is held at a plurality of rotational positions in relation to the aforementioned main tray. The aforementioned sub tray is rotatable to the following positions: a storage position, being folded to the aforementioned main tray; an opened position, being extended generally linearly from the aforementioned main tray; and a position between the aforementioned storage position and the aforementioned opened position. The aforementioned locking mechanism further comprises: a first fitting shaft provided on the aforementioned main tray; a second fitting shaft mounted rotatably to the aforementioned first fitting shaft, having a first cam and being provided on the aforementioned sub tray; an operation member which is non-rotatably and slidably engaged with the aforementioned first fitting shaft and is rotatably and slidably engaged with the aforementioned second fitting shaft, having a plurality of second cams which engage the aforementioned first cam; and pressing means for pressing the aforementioned operation member toward the side of the aforementioned sub tray. Also, the aforementioned sub tray is set to an intermediate position when continuous form is being ejected. Further, the aforementioned tray apparatus is detachably mounted to the sheet feeding device proper, and is detachably mounted to an automatic sheet feeding device in the event that an automatic sheet feeding device which feeds sheets automatically is provided to the aforementioned device proper.

Based on the above-described configuration, the sub tray of the sheet tray is set to various positions according to the size and type of sheet being used, and this setting is held by holding means. Accordingly, various types of cut sheets and continuous form can be processed by means of a single tray.

The sub tray is set to an intermediate position when continuous form is being ejected, thereby allowing guiding of the continuous form without catching thereof on the sub tray.

The tray is mounted so as to be detachable to the device proper, and is also detachably mounted to an automatic sheet feeding device in the event that such an automatic sheet feeding device is provided to the aforementioned device proper. Thus, feeding and ejecting of cut sheets and continuous form can be performed with a single feeding/ejecting tray, regardless of whether an automatic feeding device is present.

As described above, according to the present invention, a sub tray is arranged so as to be held at a plurality of rotational positions relative to a main tray, thus allowing for smooth processing of various types of cut sheets and continuous form with a single tray.

Also, the tray has been made to be detachably mounted to both the device proper and an automatic sheet feeding device, so that feeding and ejecting of cut sheets and continuous form can be performed with a single feeding/ejecting tray, regardless of whether an automatic feeding device is provided to the recording apparatus or not.

DESCRIPTION OF THE PREFERRED EMBODIMENTS

First Embodiment

Figure 1:
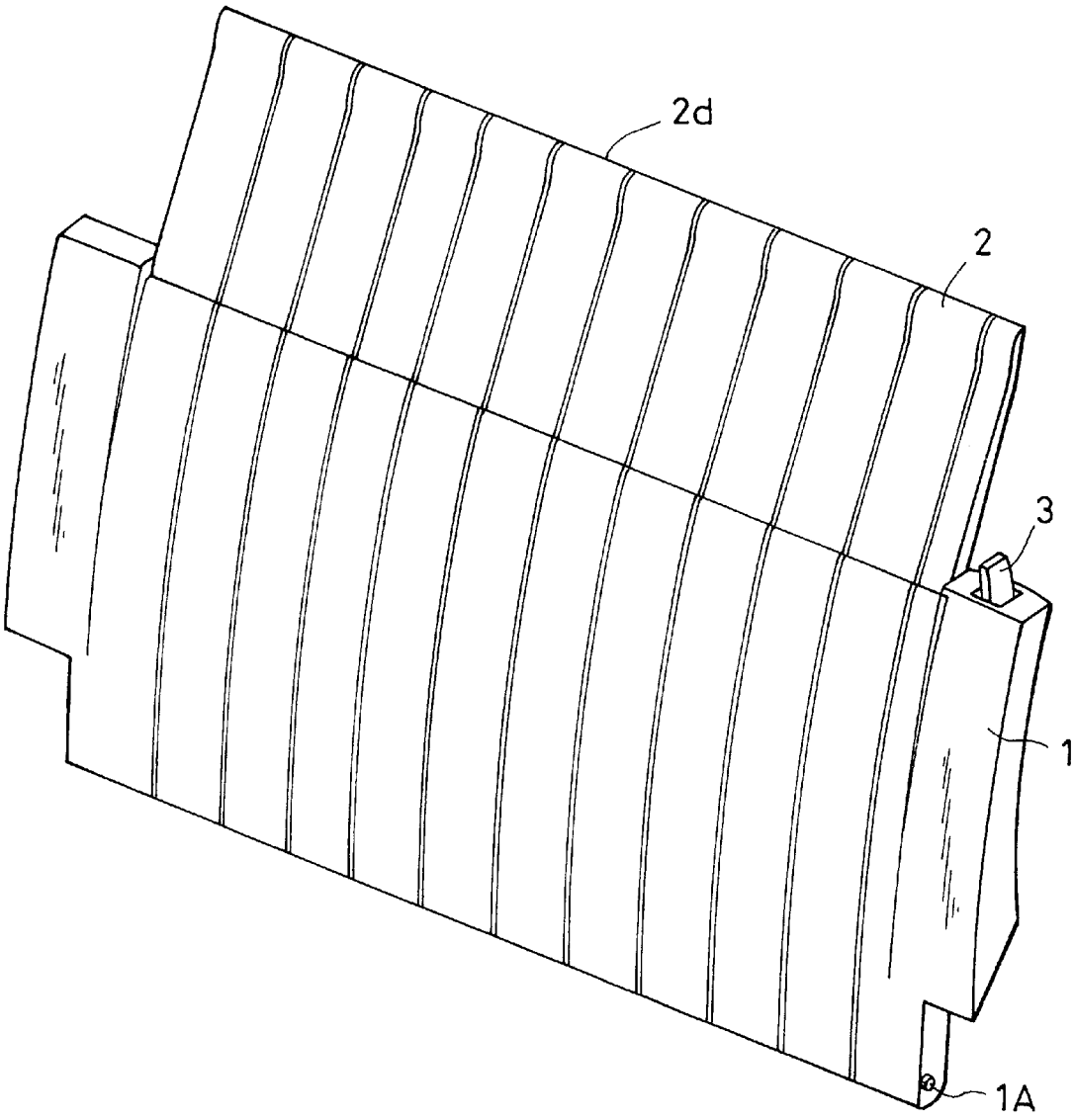
FIG. 1 is a perspective view of the feeding/ejecting tray relating to the present invention.

FIG. 1 illustrates a sheet tray 1 and 2 for sheet feeding and ejecting, having the characteristics of the present invention. This sheet tray is also referred to as a feeding/ejecting tray.

Reference numeral 1 denotes a main tray, provided with embossing 1A on either side for attachment to the main body (or automatic feeding device). Reference numeral 2 denotes a sub tray, and reference numeral 3 denotes a locking lever. The Figure illustrates the sub tray 2 being maintained in an opened position by means of the later-described locking mechanism.

Figure 2:
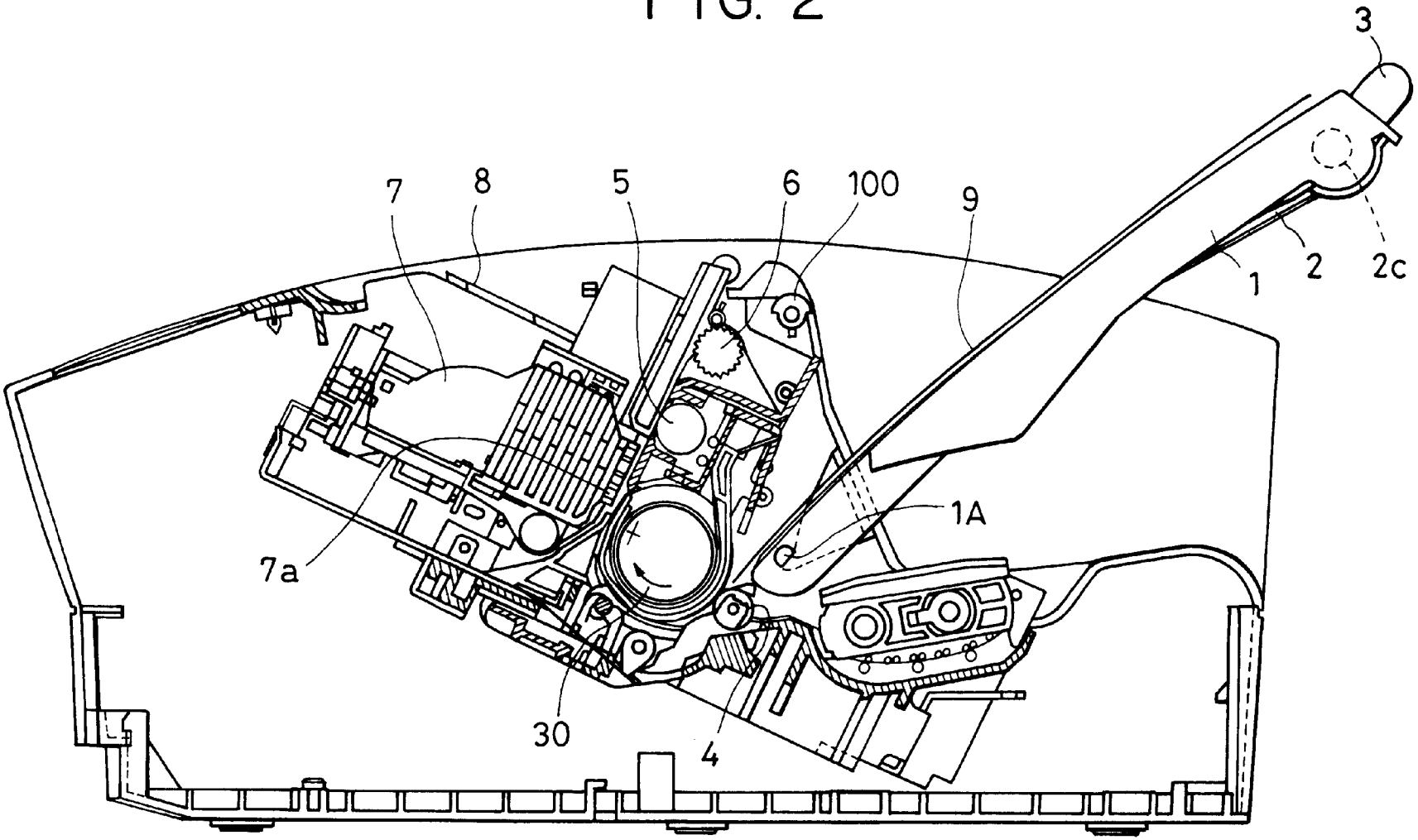
FIG. 2 is a longitudinal sectional side view of a recording apparatus provided with the feeding/ejecting tray relating to a first embodiment of the present invention, the sub tray being in the stored position.

The sheet tray 1 and 2 relating to the present invention allows for smooth processing (sheet feeding/ejecting) of both cut sheets and continuous form of various sizes. FIG. 2 is a cross sectional drawing illustrating the tray mounted to the device proper. The sub tray 2 is shown in a stored position, in which it is juxtaposed against the main tray 1 in this Figure.

In FIG. 2, reference numeral 3 denotes a roller for feeding the cut sheet 9 serving as the recording sheet, reference numeral 4 denotes a coupled roller for pressing the sheet 9 to the feeding roller 30, reference numeral 5 denotes a first ejecting roller, reference numeral 6 denotes a second ejecting roller, reference numeral 7 denotes a carriage which is mounted with a recording head (recording means) 7*a* and performs main scanning, and reference numeral 8 denotes the exterior of the apparatus.

This Figure illustrates a state wherein an automatic sheet feeding device is not provided to the apparatus proper, i.e., a state wherein the sheet 9 is manually placed one sheet at a time on the sheet tray (1 and 2). The sheet 9 used here is a widely-used A4 size sheet.

Now, with the leading edge of the sheet 9 loaded upon the main tray 1 at the nipping position between the feeding roller 30 and the coupled roller 4, the sheet 9 is ready for transport, by means of the feeding roller 30 rotating in the direction indicated by the arrow, to the printing position at which the recording head 7*a* is located. When the sheet 9 is transported to the printing position, the carriage 7 mounted with the recording head 7*a* moves in the direction of main scanning, thus performing printing upon the sheet 9. The recording sheet 9 is discharged onto the main tray 1 by means of the first and second ejecting rollers 5 and 6. Coupling rollers for pressing the sheet 9 against the ejecting rollers 5 and 6 are not shown in the Figure. Thus, sheets of sizes commonly used such as A4 or B5 can be manually fed with the sub tray 2 in the stored position, thereby reducing the space occupied by the apparatus.

Figure 3:
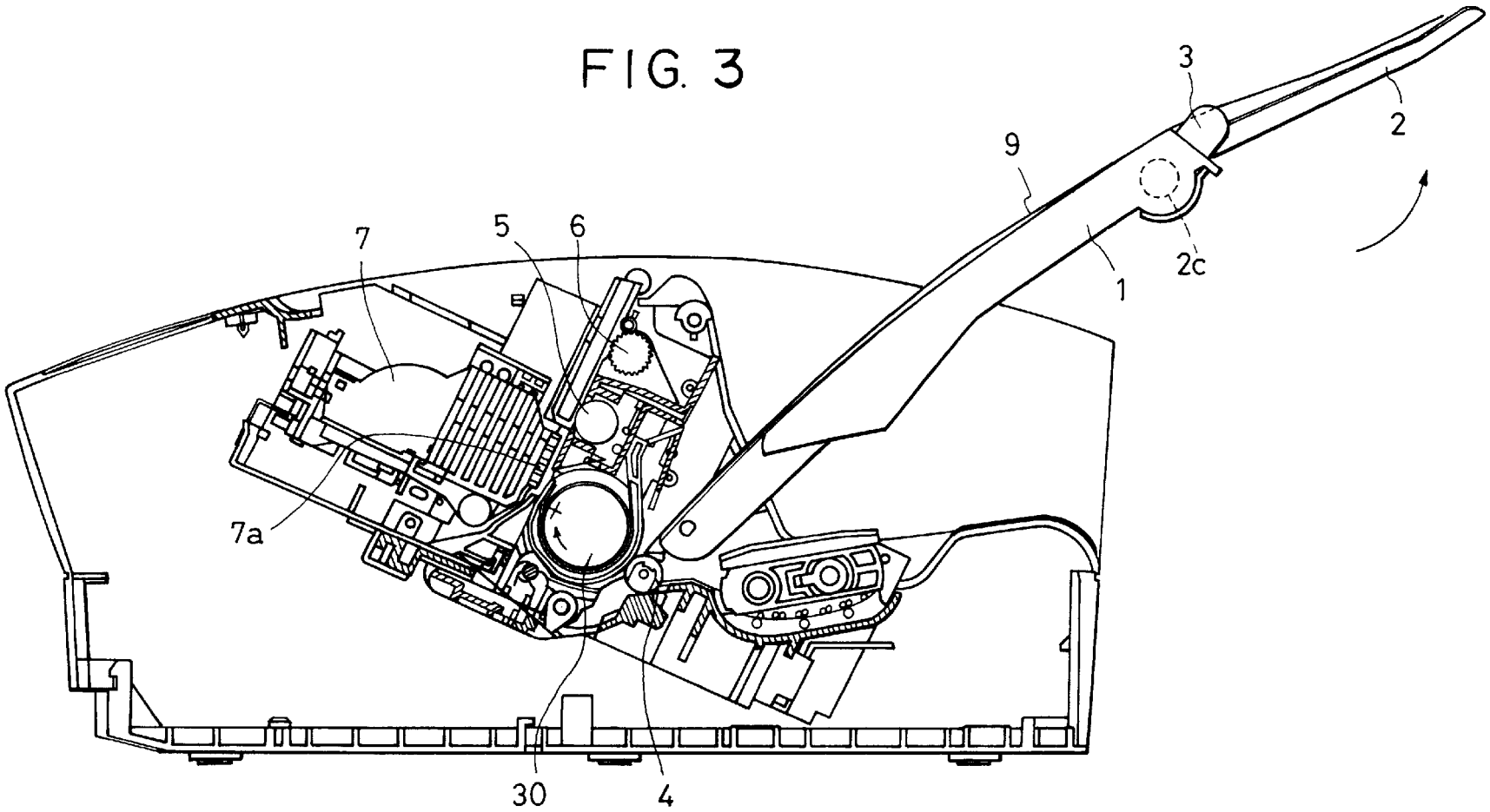
FIG. 3 is a longitudinal sectional side view of a recording apparatus provided with the feeding/ejecting tray relating to a first embodiment of the present invention, the sub tray being in the opened position.

Next, description will be made regarding manual feeding of large-size sheets such as A3 size or the like. FIG. 3 illustrates the state in which the sub tray 2 is rotated and extended from the main tray 1 so as to be in the opened position, linearly extending from the main tray 1. The locking mechanism for holding the sub tray 2 in the opened position will be described later with reference to the FIGS. 8 through 14.

As shown in FIG. 3, the overall area of the tray portion of the sheet tray is enlarged by means of rotating the sub tray 2 180°, so that large sheets such as A3 can be loaded upon the main tray 1 and sub tray 2 in a stable manner, thereby facilitating manual feeding so that the user does not need to support the paper by hand. The manually fed sheet is printed by means of the recording head 7*a* as with the arrangement shown in FIG. 2, and is returned to the tray 1 and 2.

Figure 4:
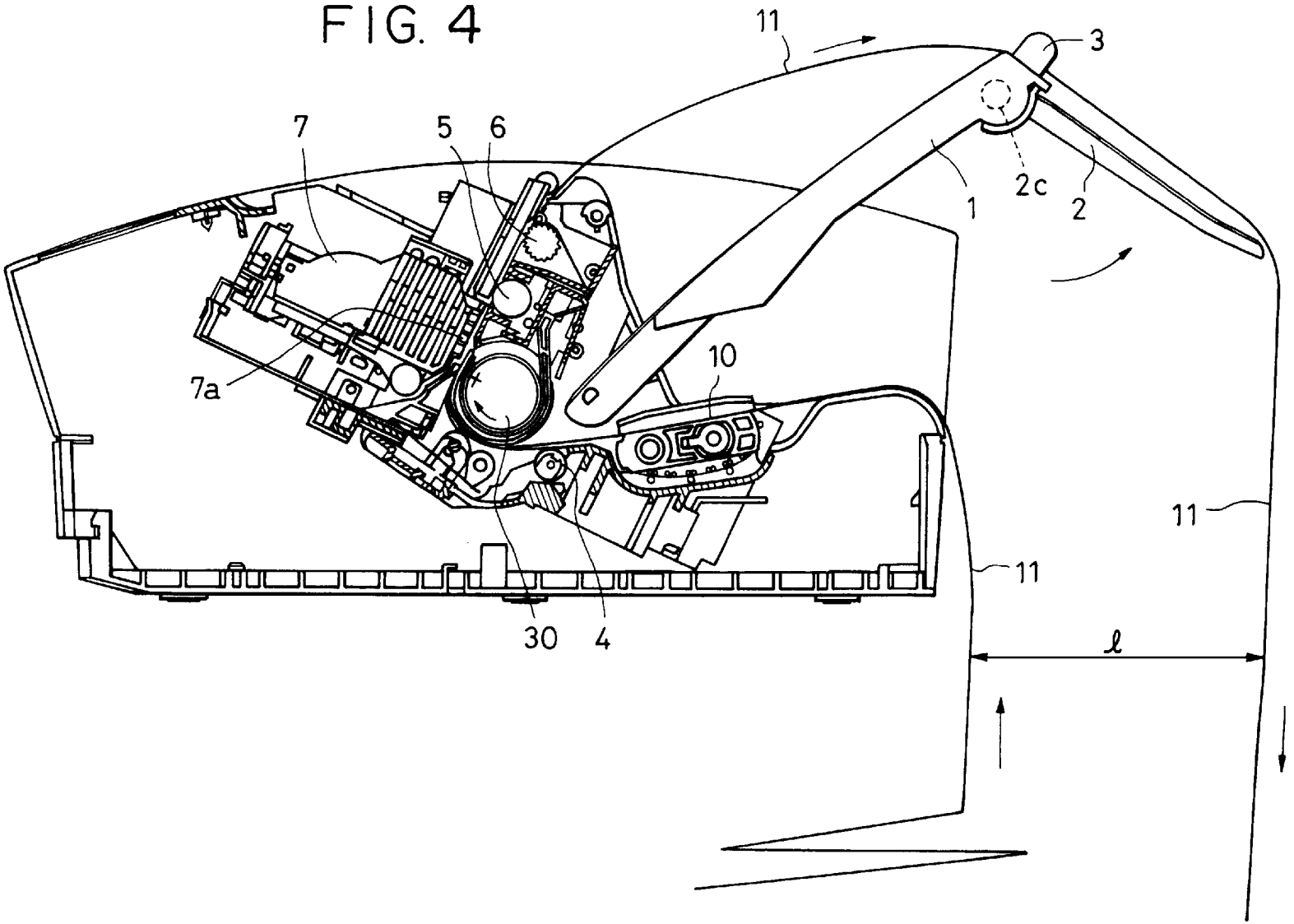
FIG. 4 is a longitudinal sectional side view of a recording apparatus provided with the feeding/ejecting tray relating to a first embodiment of the present invention, the sub tray being in an intermediate position.

Next, passage of continuous form through the apparatus will be described with reference to FIG. 4. In the Figure, reference numeral 10 denotes a tractor for engaging the holes provided in the side of the continuous form, thereby transporting the sheet, and reference numeral 11 denotes the continuous form. The continuous form sheet path construction according to the present invention is an arrangement wherein the continuous form 11 is fed from the rear side of the apparatus proper, and is further ejected from the rear side thereof.

According to such a sheet path, both the feeding and ejecting portions for the continuous form are on the same side of the recording apparatus, an advantages arrangement for operation of the recording apparatus. However, in known apparatuses there have been problems with such an arrangement. Namely, the sheets being fed and being ejected are in such close proximity that the fed sheets stick to the ejected sheets, thus causing jamming. However, as shown in the Figure, the sheet tray according to the present invention is held so that the sub tray 2 is at an intermediate position between the stored position and the opened position. Accordingly, a distance 1 is maintained between the paper being fed and the paper being ejected, by means of holding the sub tray 2 at an intermediate position between the stored position and the opened position, thus eliminating trouble such as the aforementioned jamming problem. Also, the curvature of the sheet ejected is gentle and large in radius, thus eliminating damage to the sheet.

Figure 15:
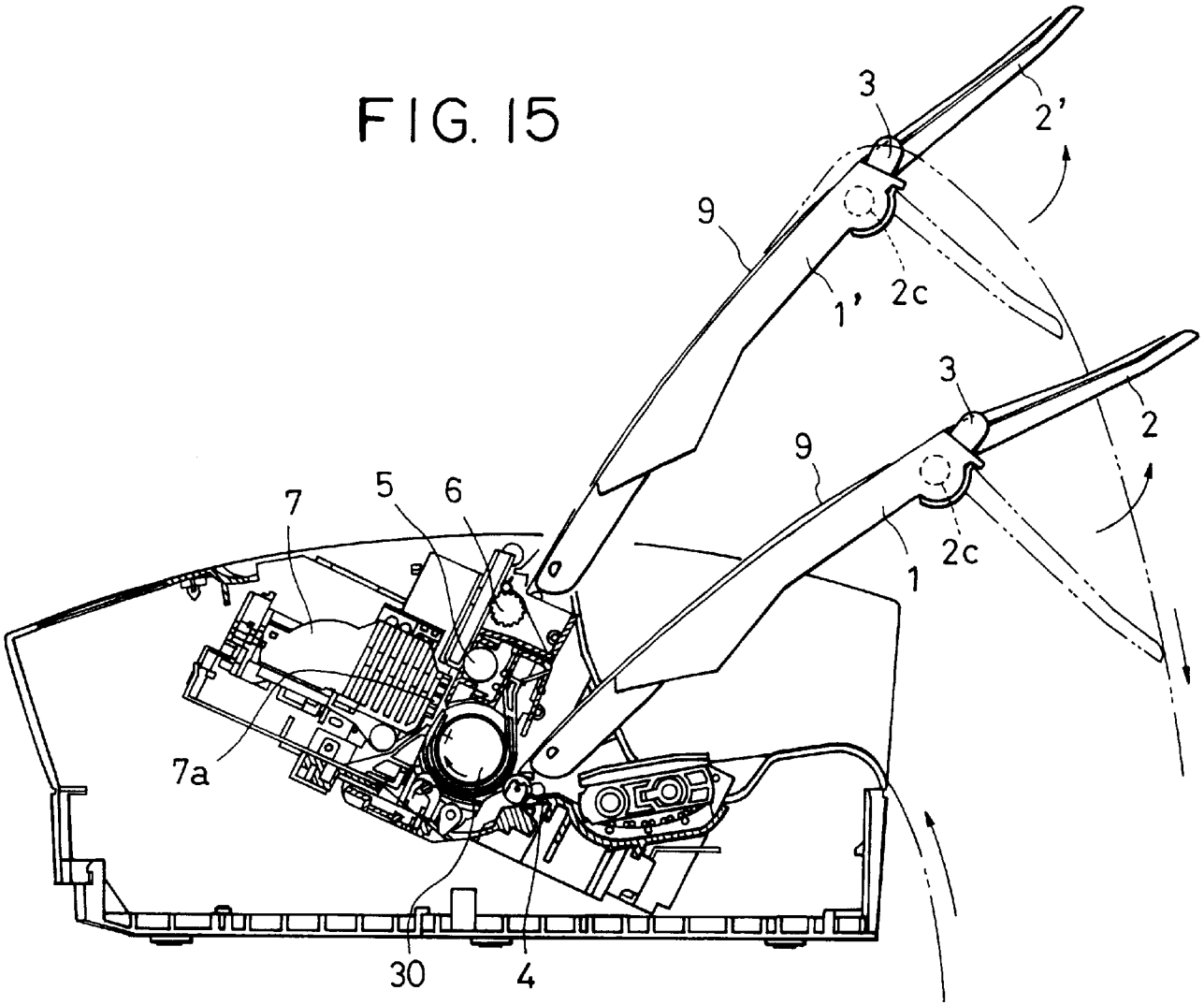
FIG. 15 is a longitudinal sectional side view of a further embodiment.

Thus, the tray 1 and 2 functions as both a feeding tray and ejecting tray, and the sub tray 2 can be maintained at three positions including the stored position, opened position, and intermediate position, each position corresponding to feeding and ejecting of various-sized cut sheets and continuous form. Although the above embodiment has been described according to an arrangement wherein the sheet tray serves both as a feeding and ejecting tray, the trays may be separated into dedicated trays, i.e., feeding tray 1 and 2 and ejecting tray 1' and 2', as shown in FIG. 15.

Second embodiment

Next, description will be made regarding a state wherein an automatic sheet feeding device is provided to the apparatus proper. Description of an example wherein widely-used A4 size sheets are fed by means of an automatic feeding device will be described with reference to FIG. 5.

Figure 5:
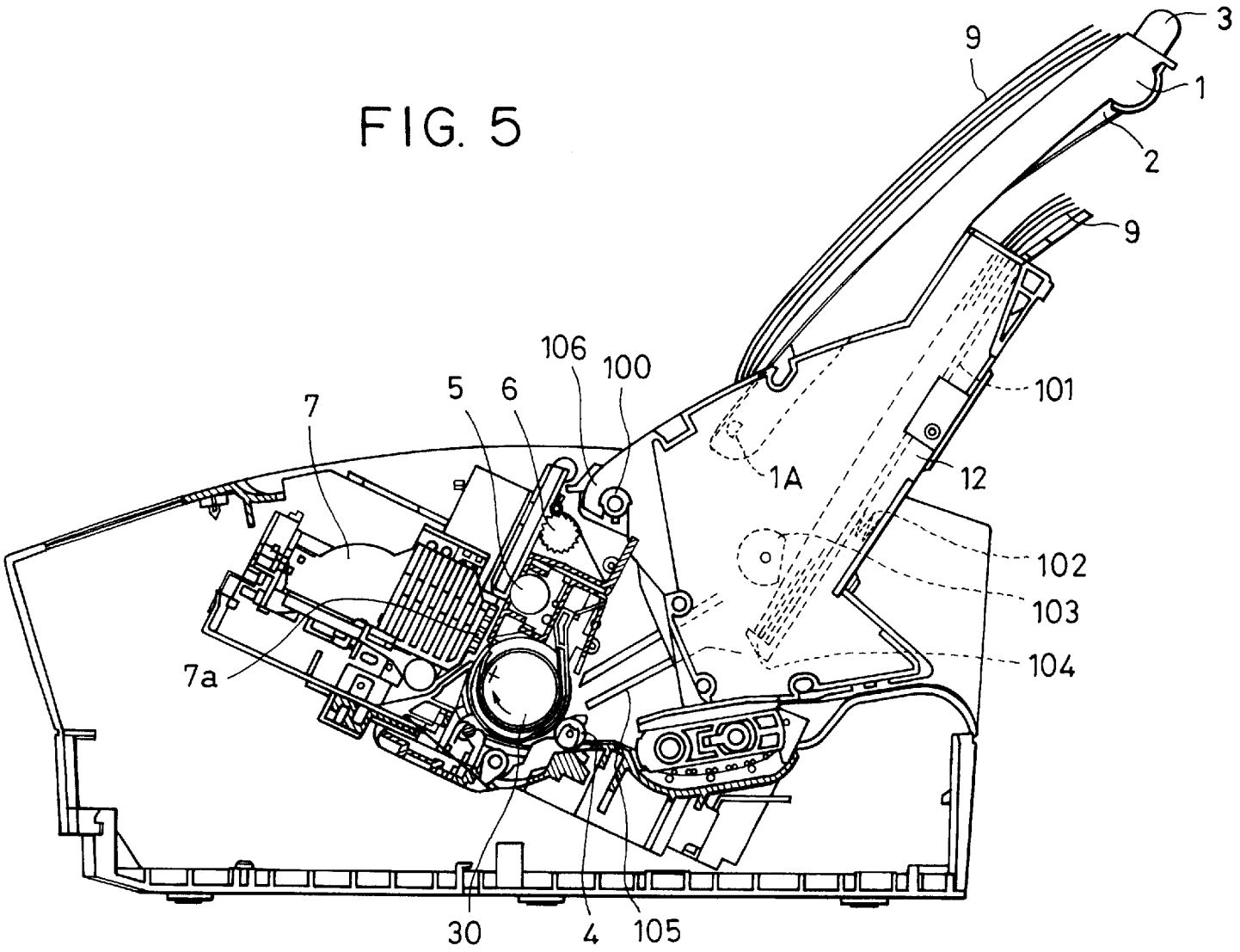
FIG. 5 is a longitudinal sectional side view of a recording apparatus with an automatic feeding device provided with the sub tray relating to a second embodiment of the present invention, the sub tray being in the stored position.

In FIG. 5, reference numeral 12 denotes an automatic feeding device mounted detachably to the apparatus proper, reference numeral 101 denotes a pressing plate, reference numeral 102 denotes a spring, reference numeral 103 denotes a feeding roller, reference numeral 104 denotes a separating claw, reference numeral 105 denotes a guide, and reference numeral 106 denotes a hook which engages a pin 100. The tray (1 and 2) is detachably mounted to the automatic feeding device 12.

As shown in FIG. 5, the sub tray 2 is in the stored position, and a number of sheets 9 are stacked upon the main tray 1.

In this way, the device can be used with the sub tray 2 stored in the event that the sheet size is not very large, thereby reducing the space occupied by the apparatus, the same as with the manual feed arrangement described with reference to FIG. 2.

Figure 6:
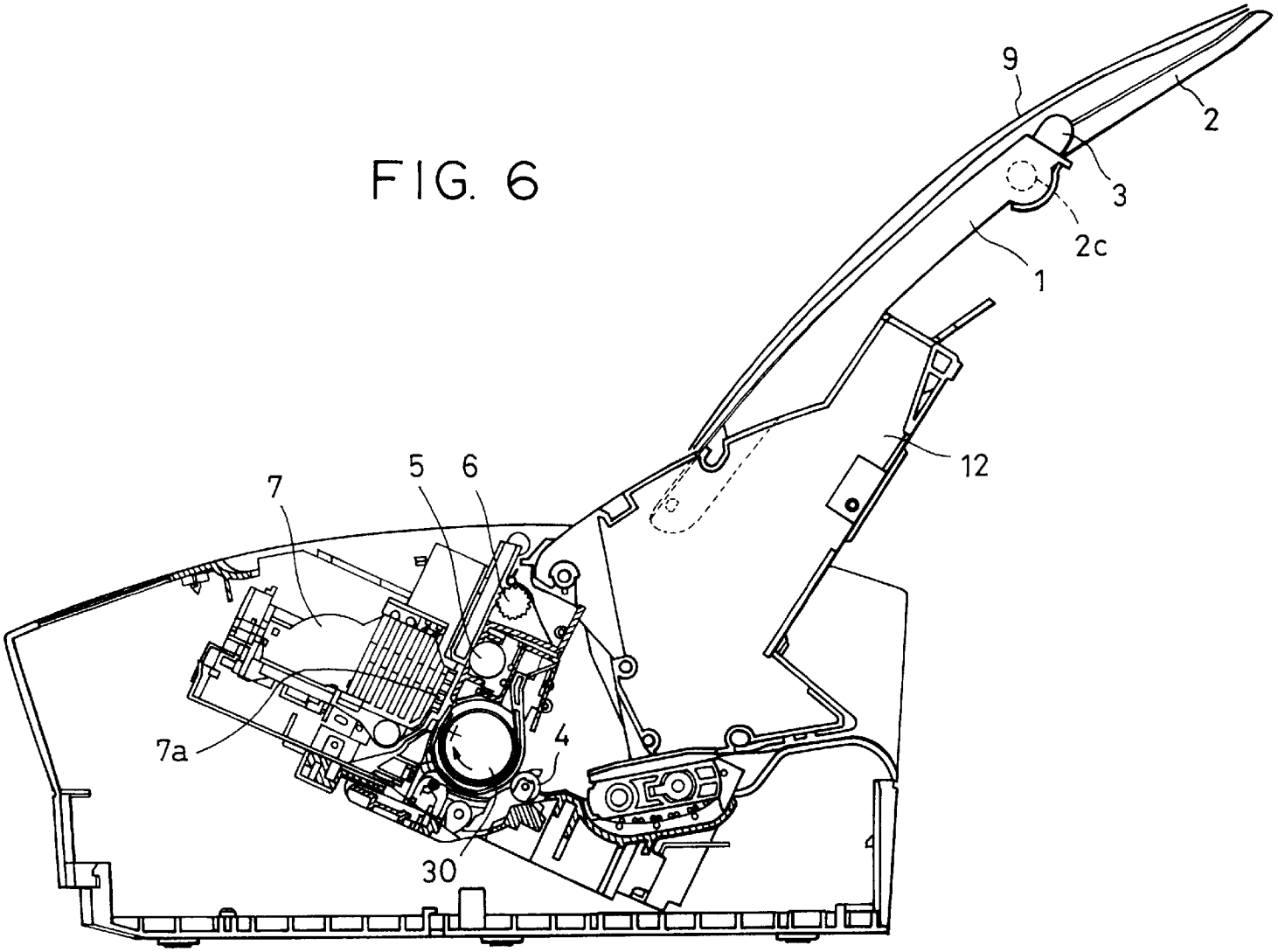
FIG. 6 is a longitudinal sectional side view of a recording apparatus with an automatic feeding device provided with the sub tray relating to a second embodiment of the present invention, the sub tray being in the opened position.

FIG. 6 illustrates an example wherein feeding of large-size sheets such as A3 size or the like is performed by means of the automatic feeding device 12. As shown in FIG. 6, the sub tray 2 is in the opened position, thus enlarging the area of the tray, so that sheets 9 of size such as A3 can be stacked thereupon with ease.

Figure 7:
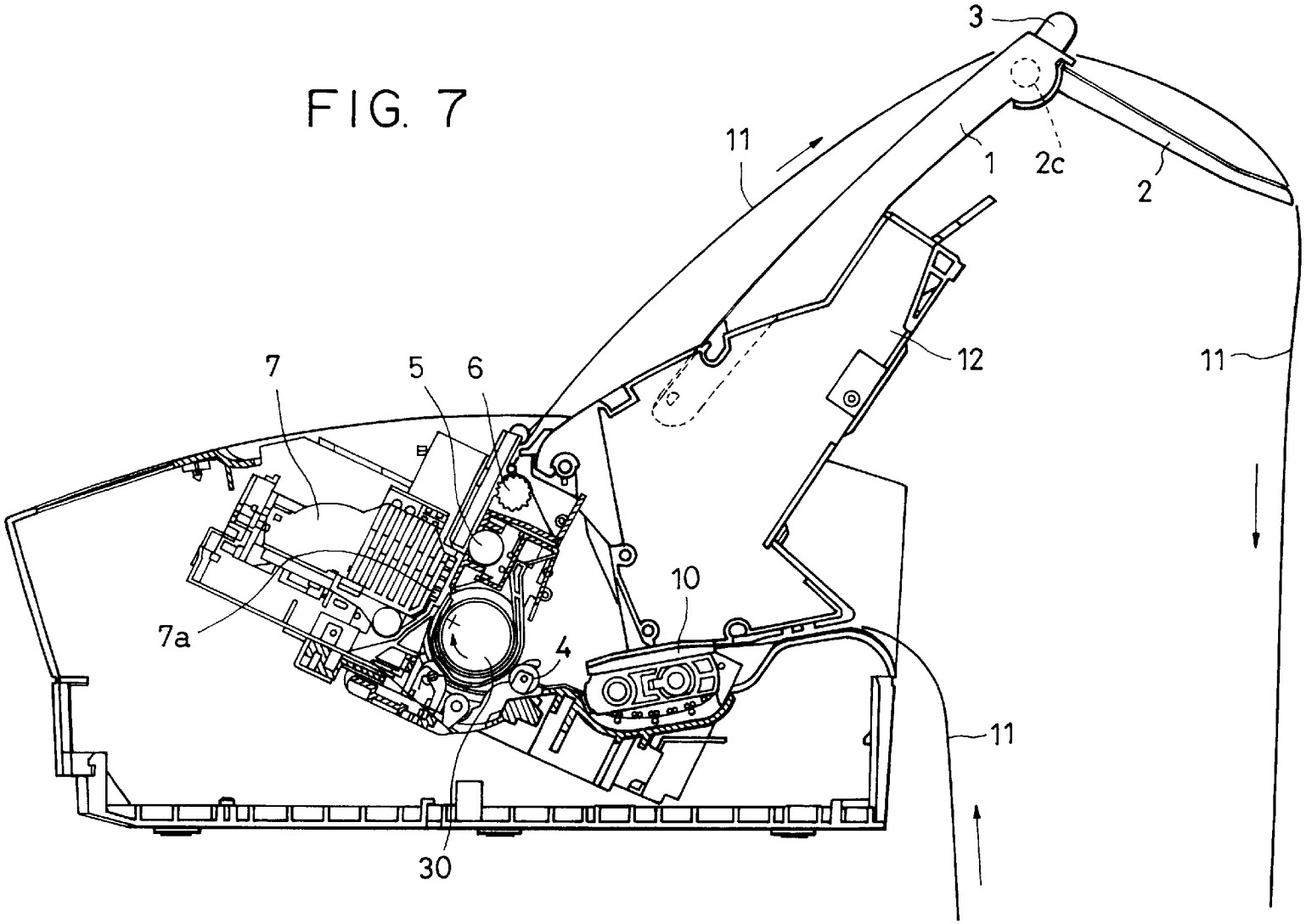
FIG. 7 is a longitudinal sectional side view of a recording apparatus with an automatic feeding device provided with the sub tray relating to a second embodiment of the present invention, the sub tray being in an intermediate position.

FIG. 7 illustrates an example wherein feeding continuous form is performed while the automatic feeding device 12 is mounted to the apparatus proper. Continuous form paper can be fed and ejected without trouble even when the automatic feeding device 12 is used, by means of setting the sub tray 2 to the intermediate position, the same as with the position described with reference to FIG. 4.

There have been problems with the present apparatus when using continuous form 11 with the automatic feeding device 12 mounted to the apparatus proper and the sub tray 2 in the stored position (the state illustrated in FIG. 5). Occasionally the continuous form catches on the upper side of the automatic feeding device 12. If the sub tray 2 were placed in the opened position (the state illustrated in FIG. 6), the first sheet of the continuous form would not climb the sub tray 2 all the way but rather would fall toward the front side.

Thus, the tray (1 and 2) according to the present invention functions as both a feeding tray and ejecting tray, regardless of whether an automatic feeding device 12 exists or not, and the sub tray 2 can be maintained at three positions including the stored position, opened position, and intermediate position, each position corresponding to processing (sheet feeding and ejecting) of various-sized cut sheets and continuous form.

Figure 8:
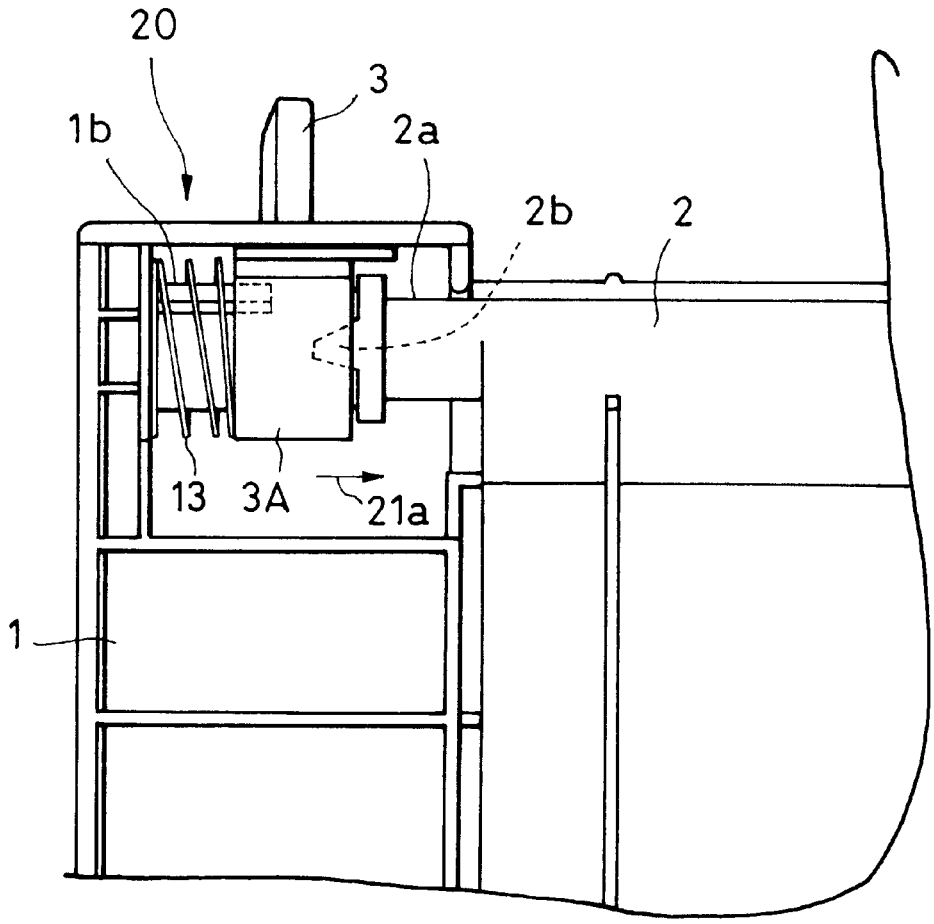
FIG. 8 is a frontal view of the sub tray locking mechanism of the feeding/ejecting tray relating to the present invention.

Next, description will be made regarding the holding mechanism of the sub tray 2 of the sheet tray (1 and 2). FIG. 8 is a plan view of the locking mechanism 20 of the sub tray of the tray (1 and 2). FIG. 8 is a view of the tray (1 and 2) as viewed from the rear, with the sub tray 2 being shown in the stored position. In the Figure, reference numeral 13 denotes a spring for applying pressure (pressing means) to an operating lever (operating member) 3.

Figure 9:
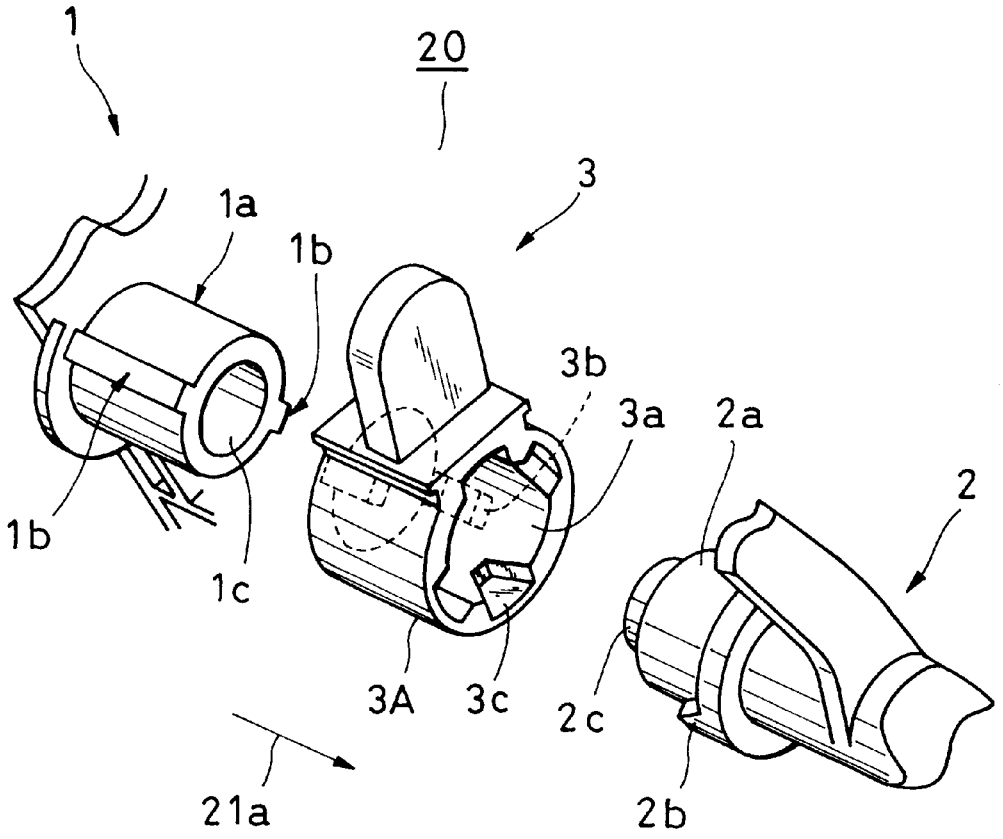
FIG. 9 is a perspective view of the same.

FIG. 9 illustrates a perspective view of the locking mechanism 20, with the pressing spring 13 being omitted to facilitate ease of viewing.

In the Figure, reference numeral 1*a* denotes a first fitting shaft provided on the main tray 1 for sliding of the boss portion 3A of the operating lever 3 thereover, reference numeral 1*b* denotes a key provided on the first fitting shaft 1*a* for restricting rotation of the operating lever 3, reference numeral 1*c* denotes a fitting hole for engaging the shaft of the sub tray 2, reference numeral 2*a* denotes a second fitting shaft provided on the side portion of the sub tray 2 for sliding of the operating lever 3 thereover, reference numeral denotes a sub tray cam 2*b* for engaging cams 3*c* of the operating lever 3, reference numeral 2*c* denotes a fitting shaft adapted to be received by the fitting hole 1*c* of the main tray 1, reference numeral 3*a* denotes a lever sliding plane of the boss portion 3A for slidably receiving the first fitting shaft 1*a* of the main tray 1 and the second fitting shaft 2*a* of the sub tray, reference numeral 3*b* denotes a key groove for receiving the key 1*b* of the main tray 1, this key groove being indicated by broken lines in the Figure, and reference numeral 3*c* denotes cams for engaging the cam 2*b* of the sub tray 2. The cams 3*c* are provided at angles that correspond to the three rotational holding positions of the sub tray 2.

The fitting hole 1*c* of the main tray 1 receives the fitting shaft 2*c* of the sub tray so that the sub tray 2 can be rotated relative to the main tray 1. The first fitting shaft 1*a* of the main tray 1 and the second fitting shaft 2*a* of the sub tray 2 are of the same diameter. The sliding plane 3*a* of the operating lever 3 receives the first fitting shaft 1*a* so that the key 1*b* prevents rotation but allows sliding in the axial direction. The sliding plane 3*a* receives the second fitting shaft 2*a* to allow rotation as well as sliding in the axial direction.

Further, the operating lever 3 is pressed in the direction indicated by the arrow 21*a*, by means of the pressing spring 13 shown in FIG. 8. Returning to FIG. 8 for explanation, the main tray 1 and the sub tray 2 can be rotated relative to one another because the fitting hole 1*c* receives fitting shaft 2*c*. The operating lever 3 is slidable in both the right and left directions upon the first sliding shaft 1*a*. The operating lever 3 is pressed in the direction of the sub tray 2 by means of the pressing spring 13.

In FIG. 8, the sub tray 2 is in the stored position. In this situation, the cam 2*b* of the sub tray has engaged one of the cams 3*c* of the operating lever 3, and this engagement is maintained by means of the pressing force of the pressing spring 13, so that the sub tray 2 is held at the stored position.

Figure 10:
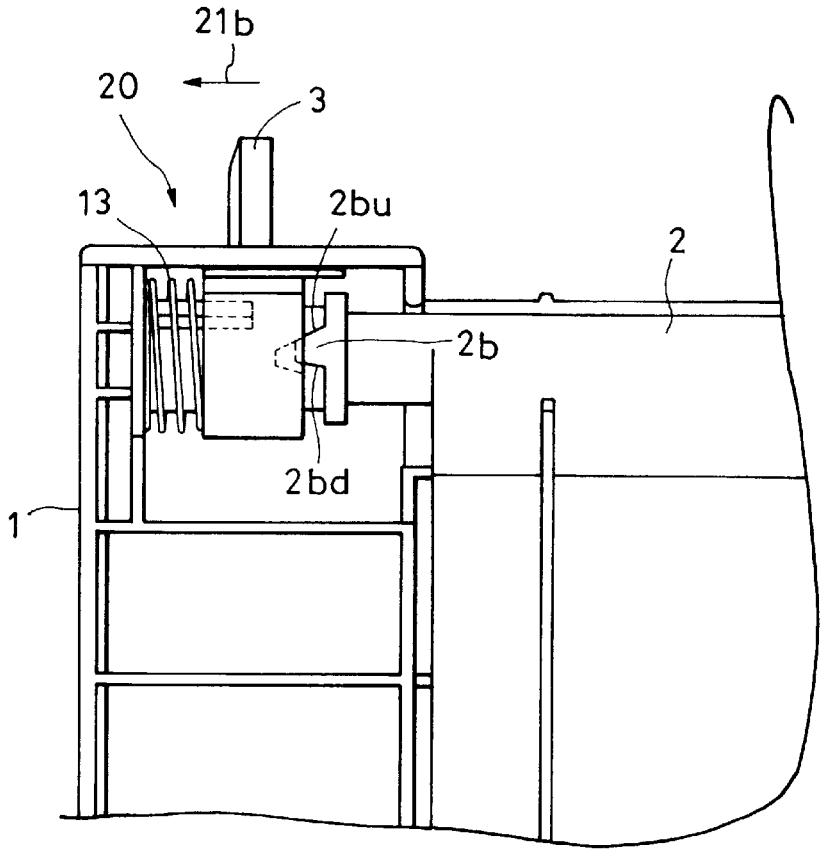
FIG. 10 is a frontal view of the locking mechanism illustrating the sub tray as it rotates.

Next, the action of extracting the sub tray 2 from the stored position will be described with reference to FIG. 10 and FIG. 11.

In order to rotate the sub tray 2 from the stored position, the free edge 2*d* (FIG. 1) of the sub tray 2 is raised by the user. Doing so causes the operation lever 3 to move in the direction of the arrow 21*b*, as shown in FIG. 10. The cam 2*b* is disengaged from the cam 3*c* of the operating lever 3, thus allowing the sub tray 2 to rotate.

Figure 11:
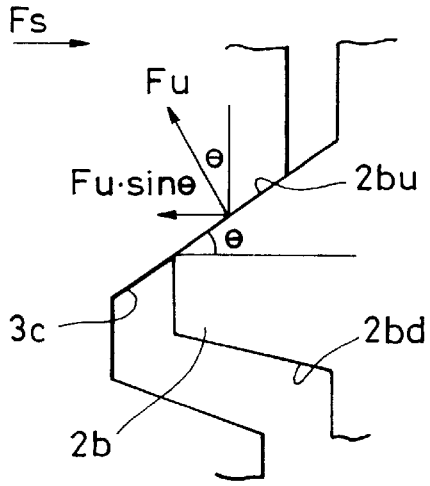
FIG. 11 is a diagram illustrating the relation of force of cams upon rotation of the sub tray.

Referring to FIG. 11, wherein 2*bu* denotes the upper side of the cam 2*b* and 2*bd* denotes the lower side thereof, the force for moving the lever in the direction of the arrow 21*b* is expressed as follows:

$$Fu \cdot \sin\theta > Fs$$

wherein Fu represents the force generated at the cam face 2*bu* by means of raising the sub tray 2, θ represents the angle of the cam plane 2*bu*, and Fs represents the pressing force of the pressing spring 13 exerted on the operating lever 3.

After rotation from the stored position, the sub tray 2 is held at an intermediate position by means of the cam 2*b* of the sub tray 2 engaging a second cam 3*c* which is provided on the operating lever 3 to hold the sub tray 2 at a certain angle.

Figure 12:
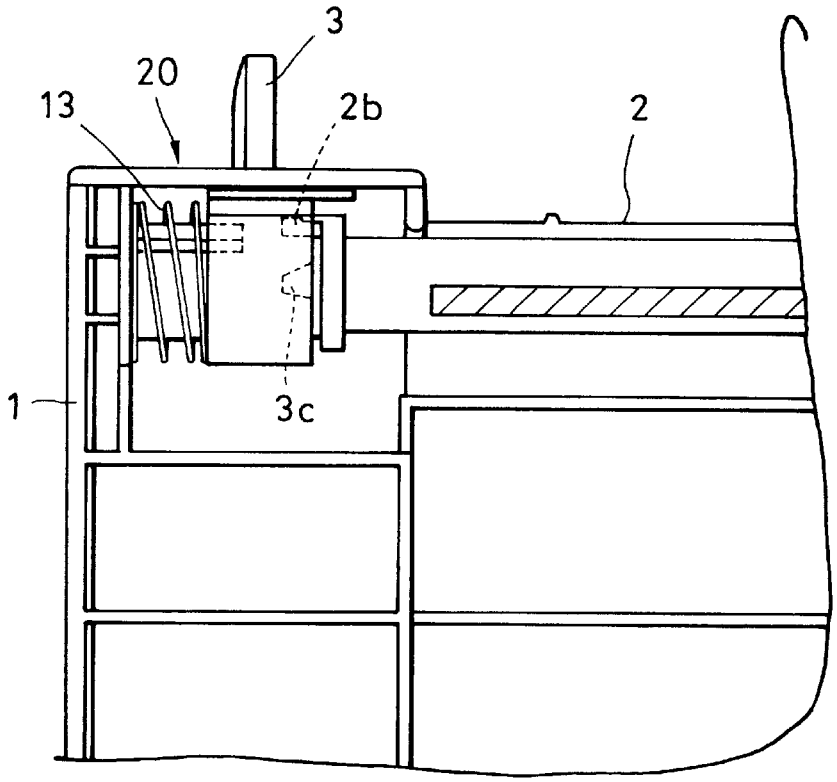
FIG. 12 is a frontal view of the locking mechanism illustrating the sub tray as it is held.
Figure 13:
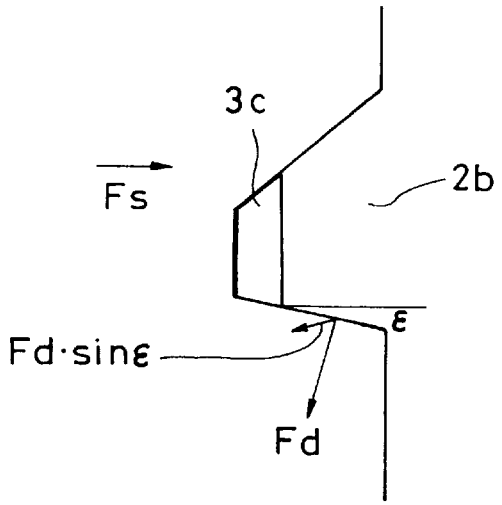
FIG. 13 is a diagram illustrating the relation of force of cams upon holding of the sub tray.

FIG. 12 illustrates that state. FIG. 13 is an enlarged view of the cam 2*b* with the sub tray being held at an intermediate position. The sub tray 2 is held at that position by setting the angle ϵ in accordance with the following expression:

$$\sin\epsilon < Fs/Fd$$

wherein Fd represents the force placed on the cam 2*b* by the weight of the sub tray 2, ϵ represents the angle of the cam plane 2*bd*, and Fs represents the pressing force applied to the operating lever 3 by the pressing spring 13, the same as in FIG. 11.

The sub tray 2 is held at an opened position as shown in FIG. 1 by means of raising the sub tray 2 from the intermediate position. As this happens, the cam 2*b* is disengaged from the cam 3*c* of the operating lever 3 and engaged with the next cam 3*c*.

Figure 14:
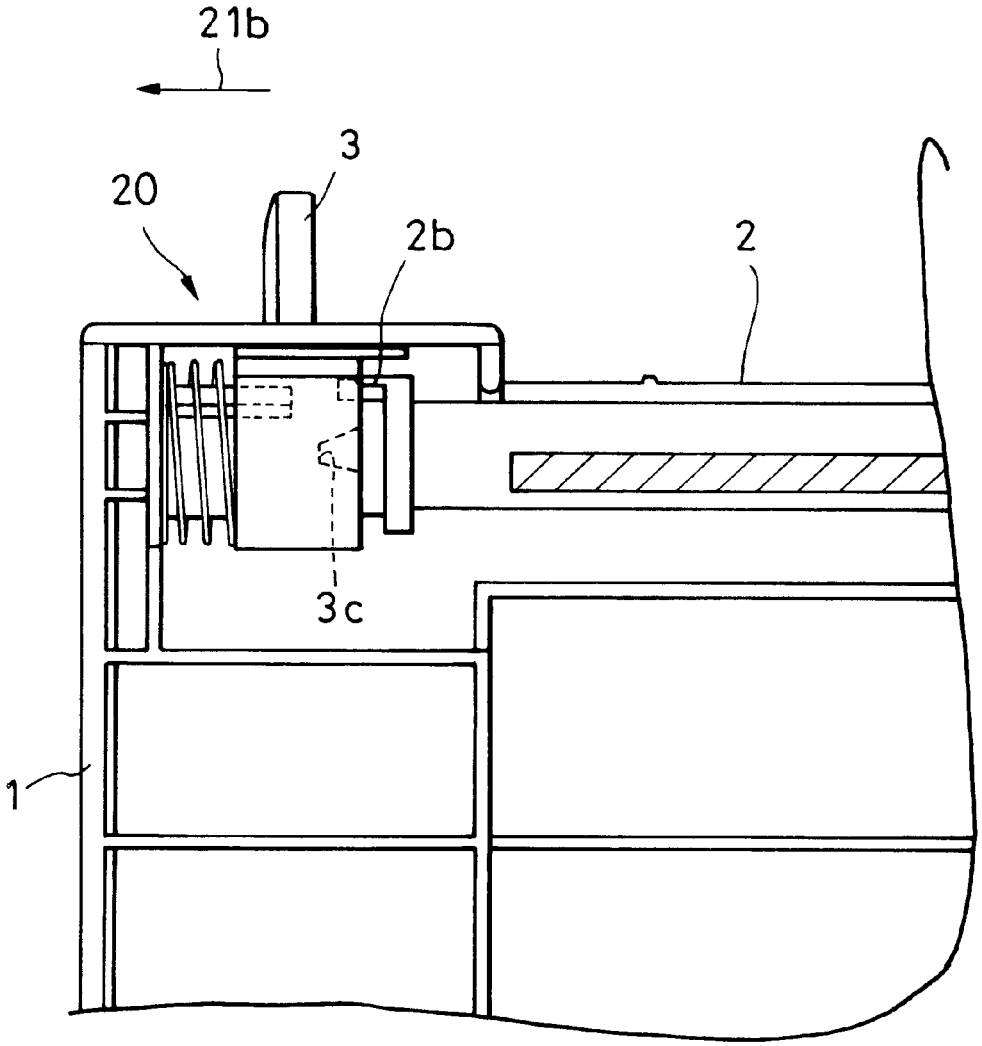
FIG. 14 is a frontal view of the locking mechanism illustrating locking of the sub tray being disengaged.

FIG. 14 illustrates the action of disengaging the sub tray 2. As shown in the Figure, moving the operating lever 3 in the direction of the arrow 21*b* causes the cam 3*c* of the operating lever 3 to be disengaged from the cam 2*b* of the second fitting shaft 2*a*, thus allowing the sub tray 2 to rotate.

As described above, the holding angle (setting position) of the sub tray 2 can be arbitrarily determined by the phase of the cam 2*b* and operating lever 3 as relating to the cam 3*c*. The operating force necessary to raise the sub tray 2 and the operating force necessary to disengage the operating lever 3 from the sub tray 2 also can be set arbitrarily by adjusting the pressing force of the pressing spring 13 and the angle of the cam face.

What is claimed is:

1. A sheet tray device for loading sheets, comprising:

a main tray for loading sheets;

a sub tray pivotally connected to said main tray so that said sub tray is rotatable relative to said main tray; and a locking mechanism for holding said sub tray at any one of a plurality of rotational operating positions.

2. A sheet tray device according to claim 1, wherein said sub tray is rotatable to a storage position, in which said sub tray is juxtaposed against said main tray;

wherein said plurality of rotational operating positions of said sub tray includes:

an opened operating position, in which said sub tray extends generally linearly from said main tray; and an intermediate operating position, in which said sub tray is held at a rotational position between said storage position and said opened operating position.

3. A sheet tray device according to claim 2, wherein said sub tray is held at said intermediate operating position when continuous form is used in conjunction with said tray device.

4. A sheet tray device according to claim 1, said locking mechanism further comprising:

a first fitting shaft provided to said main tray;

a second fitting shaft provided on said sub tray, said second fitting shaft being mounted rotatably to said first fitting shaft, and having a first cam provided thereon;

an operating member which is non-rotatably and slidably engaged with said first fitting shaft and is rotatably and slidably engaged with said second fitting shaft, said operating member having a plurality of second cams, each of which is adapted to engage said first cam; and pressing means for pressing said operating member toward said sub tray so that a different one of said plurality of second cams engages said first cam when said sub tray is held in each of said plurality of rotational operating positions.

5. A sheet tray device according to claim 1, wherein said sheet tray device is detachably mounted to a sheet feeding device, and is detachably mounted to an automatic sheet feeding device in the event that the automatic sheet feeding device is provided to said sheet feeding device.

6. A sheet tray device according to claim 1, wherein said plurality of rotational operating positions of said sub tray includes:

a first operating position, in which said sub tray extends from said main tray to allow for loading of sheets of large size; and a second operating position, in which said sub tray is rotated downwardly from said first operating position to guide continuous form downwards.

7. A sheet feeding device, comprising:

a sheet tray device comprising a main tray for loading sheets, a sub tray pivotally connected to said main tray so that said sub tray can be rotated relative to said main tray, and a locking mechanism for holding said sub tray at any one of a plurality of rotational operating positions;

means for feeding sheets loaded on said main tray of said sheet tray device;

means for processing fed sheets; and feeding means for feeding processed sheets to said main tray.

8. A sheet feeding device according to claim 7, wherein said processing means comprise recording means.

9. A sheet feeding device according to claim 7, wherein said sheet tray device is detachably mounted to said sheet feeding device.

10. A sheet feeding device according to claim 7, wherein said sheet feeding means comprise automatic sheet feeding means, and said sheet tray device is detachably mounted to said automatic sheet feeding means.

11. A sheet feeding device according to claim 10, wherein said automatic sheet feeding means is detachably mounted to said sheet feeding device.

12. A sheet feeding device according to claim 7, wherein said sheet feeding means comprises a tractor for feeding continuous form, and the continuous form fed by said tractor through said processing means is guided downwards via said main tray and said sub tray.

13. A sheet tray device for loading sheets, comprising:

a main tray for loading sheets;

a sub tray provided rotatably to the edge of said main tray; and a locking mechanism for holding the rotational position of said sub tray;

wherein said sub tray is held at a plurality of rotational positions in relation to said main tray;

wherein a plurality of rotational position of said sub tray is:

first position which extends from said main tray and allows for loading of sheets of large size;

second position which bends downward from said main tray and guides continuous form downwards; and a storage position, being folded to main tray.

* * * * *

UNITED STATES PATENT AND TRADEMARK OFFICE

CERTIFICATE OF CORRECTION

PATENT NO. : 5,984,300

DATED : November 16, 1999

INVENTOR(S): NOZOMU NISHIBERI

It is certified that error appears in the above-identified patent and that said Letters Patent is hereby corrected as shown below:

COVER PAGE AT ITEM [56] RC:
Foreign Patent Documents: "2276729" and "5278868" should read --2-276729-- and --5-278868--, respectively.

COLUMN 4:
Line 25, "advantages" should read --advantageous--; and
Line 34, "distance 1" should read --distance l--.

COLUMN 5:
Line 55, "numeral" should read --numeral 2b--; and
Line 56, "2b" should be deleted.

COLUMN 7:
Line 57, "includes:" should read --include:--.

UNITED STATES PATENT AND TRADEMARK OFFICE

CERTIFICATE OF CORRECTION

PATENT NO. : 5,984,300

DATED : November 16, 1999

INVENTOR(S): NOZOMU NISHIBERI

It is certified that error appears in the above-identified patent and that said Letters Patent is hereby corrected as shown below:

COLUMN 8:

Line 48, "position" should read --positions--; and

Line 49, "is:" should read --are:--.

Signed and Sealed this

Seventeenth Day of October, 2000

*Attest:*

Q. TODD DICKINSON

*Attesting Officer*

*Director of Patents and Trademarks*